US006547324B1

(12) United States Patent
Ammann, Jr.

(10) Patent No.: US 6,547,324 B1
(45) Date of Patent: Apr. 15, 2003

(54) PORTABLE CHAIR

(76) Inventor: Leslie G. Ammann, Jr., 437 Lockewood La., Scotts Valley, CA (US) 95066

( * ) Notice: Subject to any disclaimer, the term of this patent is extended or adjusted under 35 U.S.C. 154(b) by 0 days.

(21) Appl. No.: 09/248,742

(22) Filed: Feb. 10, 1999

Related U.S. Application Data

(63) Continuation-in-part of application No. PCT/US98/04083, filed on Mar. 3, 1998, and a continuation-in-part of application No. 08/812,108, filed on Mar. 5, 1997.

(51) Int. Cl.[7] ..... A47C 13/00; A45R 4/02

(52) U.S. Cl. ..... 297/129; 297/188.04; 297/188.06; 297/52; 297/35; 297/61; 297/26; 224/155

(58) Field of Search ..... 297/16.1, 17, 26, 297/35, 52, 53, 54, 56, 118, 129, 188.06, 188.04, 188.05, 61, 397, 408, 391; 224/155, 153, 156, 633, 634

(56) References Cited

U.S. PATENT DOCUMENTS

| | | | | | |
|---|---|---|---|---|---|
| 184,936 | A | * | 11/1876 | Ware | 297/35 |
| 1,349,271 | A | * | 8/1920 | Fisher | 297/35 |
| 1,821,704 | A | | 9/1931 | Grossman | 297/52 |
| 3,077,327 | A | * | 2/1963 | Batie et al. | 297/52 X |
| 3,182,614 | A | | 5/1965 | McLean | |
| 3,895,839 | A | * | 7/1975 | Amato | 297/26 X |
| 4,387,924 | A | | 6/1983 | Fernandez | 297/217.1 |
| 4,527,829 | A | * | 7/1985 | Fanslau et al. | 297/16.1 X |
| 4,676,548 | A | * | 6/1987 | Bradbury | 297/129 X |
| 4,773,574 | A | | 9/1988 | Burgard | |
| 5,318,342 | A | | 6/1994 | Hale | 297/129 |
| 5,409,291 | A | | 4/1995 | Lamb et al. | 297/129 |
| 5,533,654 | A | | 7/1996 | Holty et al. | |
| 5,628,437 | A | | 5/1997 | Kober | |
| 5,722,717 | A | * | 3/1998 | Rettenberger | 297/52 X |
| 6,048,023 | A | * | 4/2000 | Lampton | 297/188.06 |

* cited by examiner

*Primary Examiner*—Anthony D. Barfield
(74) *Attorney, Agent, or Firm*—Eric Karich

(57) ABSTRACT

A portable chair has a front and rear seat support frames hingably joined for rotating the seat support frames between a first folded mutually aligned position for carrying the combination, and a second unfolded, spread apart position for sitting. The chair further includes a chair seat joining the pair of seat support frames and providing an upwardly facing surface when the seat support frames are in the second spread apart position. A back support frame is hingably joined to one of the pair of seat support frames and rotatable between an upwardly extending position for establishing a back rest, and a laid-over position wherein the back support frame abuts the chair seat. Attached to the back support frame is a backpack removably joined to the back support frame. A pair of shoulder straps are attached to one of the seat support frames such that with the seat support frames are placed into the mutually aligned position, and with the back support frame placed into the laid-over position, the combination is mountable onto a person's back. The chair further includes a headrest and a pair of arm rests in the preferred embodiment.

15 Claims, 6 Drawing Sheets

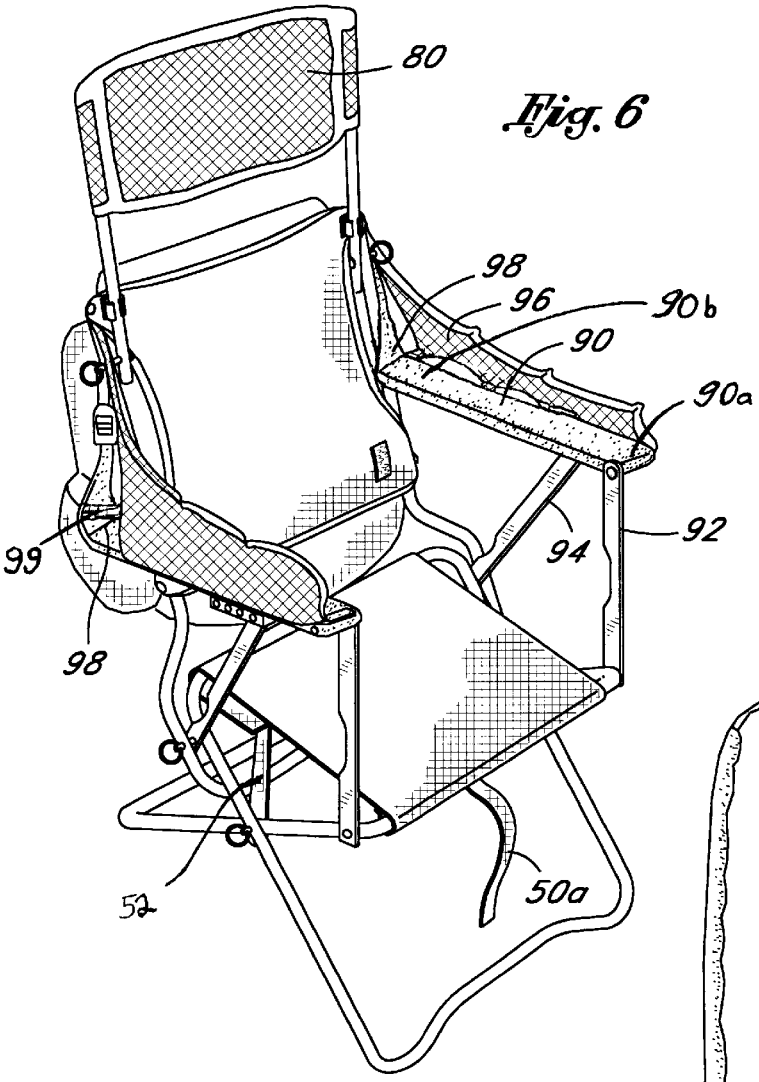
Fig. 6
Fig. 7
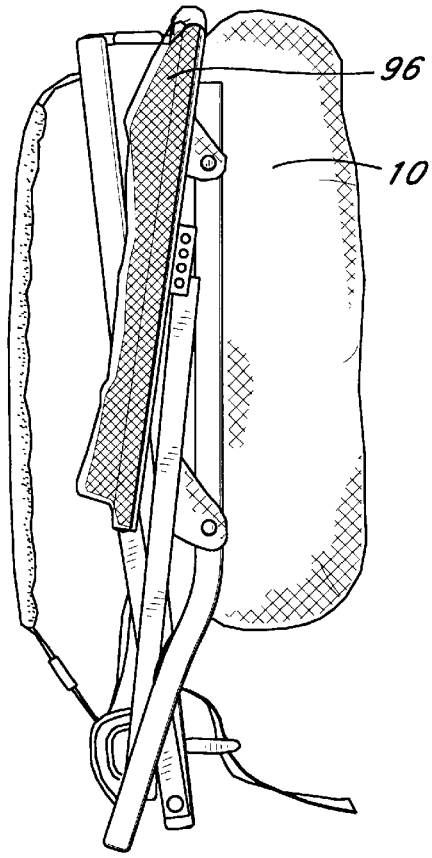

PORTABLE CHAIR

This is a continuation-in-part of U.S. application Ser. No. 08/812,108, filed Mar. 5, 1997; and is a continuation-in-part of International Application No. PCT/US98/04083, filed Mar. 3, 1998.

BACKGROUND OF THE INVENTION

1. Field of the Invention

This invention relates to portable chairs. Specifically, this invention relates to a chair that can quickly and easily be converted into a folded, portable backpack configuration, the chair preferably including an arm rest, a headrest, and a backpack for transporting additional items along with the portable chair.

2. Description of Related Art

There are many types of portable chairs available and common to the marketplace. There are indoor and outdoor chairs of many different shapes and sizes; some chairs are permanent, others either movable or portable. Some portable chairs can be folded into sections to ease in transporting and storage. Portable chairs do not generally include arm rests and headrests due to the difficulty of folding these elements along with the rest of the chair into an easily portable configuration.

There are also many bags and backpacks available in today's marketplace. Different bags, containers, coolers, and other carrying devices are well known in the art. There are also a wide variety of backpacks available in the marketplace. Some backpacks are available are for everyday use, while others are used for hiking and camping.

Due to their mobile nature, portable chairs are often carried with bags and backpacks. For example, when attending outdoor sporting events and outdoor concerts, it is often required that the attendees bring their own chairs. These attendees usually also wish to bring additional materials such as food, cameras, and other miscellaneous articles. Such articles are best carried together in a bag or pack. Unfortunately, it is not easy for a single person to carry both a chair and a pack of food and other articles. It is not easy to transport the folding chairs currently on the market. These chairs are cumbersome to carry and difficult to hold. The weight of the chair is unbalanced when it is in the folded position; and the chair tends to come unfolded during transportation. Carrying a chair becomes doubly difficult if the person is also carrying a bag full of food and other articles. This chore can becomes nearly impossible is the person is also carrying or attending a small child.

To solve this problem, inventors have created several portable chairs that include a bag or backpack. Examples of such combinations are disclosed in Rettenberger, U.S. Pat. No. 5,722,717, Kober, U.S. Pat. No. 5,628,437, Lamb at al., U.S. Pat. No. 5,409,291, Hale, U.S. Pat. No. 5,318,342, Bradbury, U.S. Pat. No. 4,676,548, and Batie, U.S. Pat. No. 3,077,327. The majority of these prior art inventions use a folding lawn-chair style chair with a backpack mounted on one of various parts of the chair. These chairs are all extremely cumbersome and difficult to manage; and they are uncomfortable and clumsy in use. Batie and Rettenberger both disclose combination chair and backpacks utilizing a three-frame folding chair similar to the instant invention; however, neither of these chairs mount a backpack on the back of the chair. The structural instability of these designs precludes mounting anything on the back of the chair; and indeed, the chairs are so poorly designed they tend to collapse when there is nobody sitting in the chair.

Furthermore, the chairs do not easily convert into a portable configuration, and none of these inventions include a headrest and arm rests.

Other prior art inventions include U.S. Pat. No. 4,773,574 to Burgard (1988), which discloses a pack having first and second rectangular frames which are pivotally interconnected to form a chair which folds into a backpack. This invention suffers from several serious disadvantages. First, the pack portion is located on the underside of the seat rather than the back of the chair. Second, the support legs are all of the same length, causing the chair to lack the stability achieved in the present invention. Third, this patent describes what is essentially a two-frame structure that does not fold or lock satisfactorily. U.S. Pat. No. 4,687,248 to Ross and Friedman (1987) discloses a tote-bag with a complex construction that transforms into a chair by a slow complex step-by-step process. This tote-bag is not preferred because of the cumbersome process to achieve portability. U.S. Pat. No. 4,190,918 to Glenn M Harvell (1978), discloses a simple carry suitcase cushion that folds out into a double cushion. This invention does not allow any amenities to be transported inside and only provides a cushion that must be used atop of an existing chair or bench. U.S. Pat. No. 4,676,548 to Patrick H. Bradbury (1987) discloses a bulky and uncomfortable lawn chair with a pack on the back.

The prior art teaches various portable chairs; and some of the prior art even teaches a portably chair having a backpack. However, the prior art does not teach a three-frame portable chair having a backpack mounted on the back, making the backpack easy to use and convenient. The prior art also does not teach a portable chair with an arm-rest or a headrest. The present invention fulfills these needs and provides further related advantages as described in the following summary.

SUMMARY OF THE INVENTION

The present invention provides a portable chair having front and rear seat support frames hingably joined for rotating the seat support frames between a first mutually aligned position for carrying the combination, and a second spread apart position for sitting. The chair further includes a seat means for joining the pair of seat support frames and providing an upwardly facing surface when the seat support frames are in the second spread apart position, whereby the support frames are self supporting on a support surface for placing the sitting means at a convenient height. A back support frame is hingably joined to one of the pair of seat support frames and rotatable between an upwardly extending position for establishing a back rest, and a laid-over position wherein the back support frame abuts the sitting means. The chair includes an arm rest and a headrest that fold with the chair and do not interfere with the chair's portability.

A backpack is preferably attached to the back support frame of the chair. A shoulder mounting means is attached to the pair of seat support frames such that with the pair of set support frames placed into the mutually aligned position, and with the back support frame placed into the laid-over position, the combination is mountable onto a person's back for carrying thereon. The chair further preferably includes a headrest and at least one arm rest.

A primary objective of the present invention is to provide a portable chair having advantages not taught by the prior art.

Another objective is to provide a portable chair with arm rests and a head rest, the chair maintaining an overall structure that allows easily converting the chair into a folded and portable configuration. It is critical that the headrest and the arm rests fold themselves easily into a compact structure without requiring the user to disassemble any components or carry them separately.

Another objective is to provide a portable chair having a backpack mounted on the back of the chair when the chair is unfolded. Prior art inventions mount the backpack in inaccessible locations such as the underside of the seat. Placing the backpack on the back of the seat is preferably because it places the backpack in a more accessible position. It also allows for a much larger backpack because it is not limited to he space between the legs of the chair.

A further objective is to provide a portable chair on which the support legs of the rear leg frame are longer than the support arms of the front leg frame. This structural feature allows the chair to remain upright when the pack is full and nobody is sitting in the chair.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings:

FIG. 6 is a perspective view of a preferred embodiment of the chair in its unfolded configuration, the chair having two arm rests and a head rest;

FIG. 7 is a side elevational view thereof, the chair being in its folded configuration.

DETAILED DESCRIPTION OF THE PREFERRED EMBODIMENT

Figure 1:
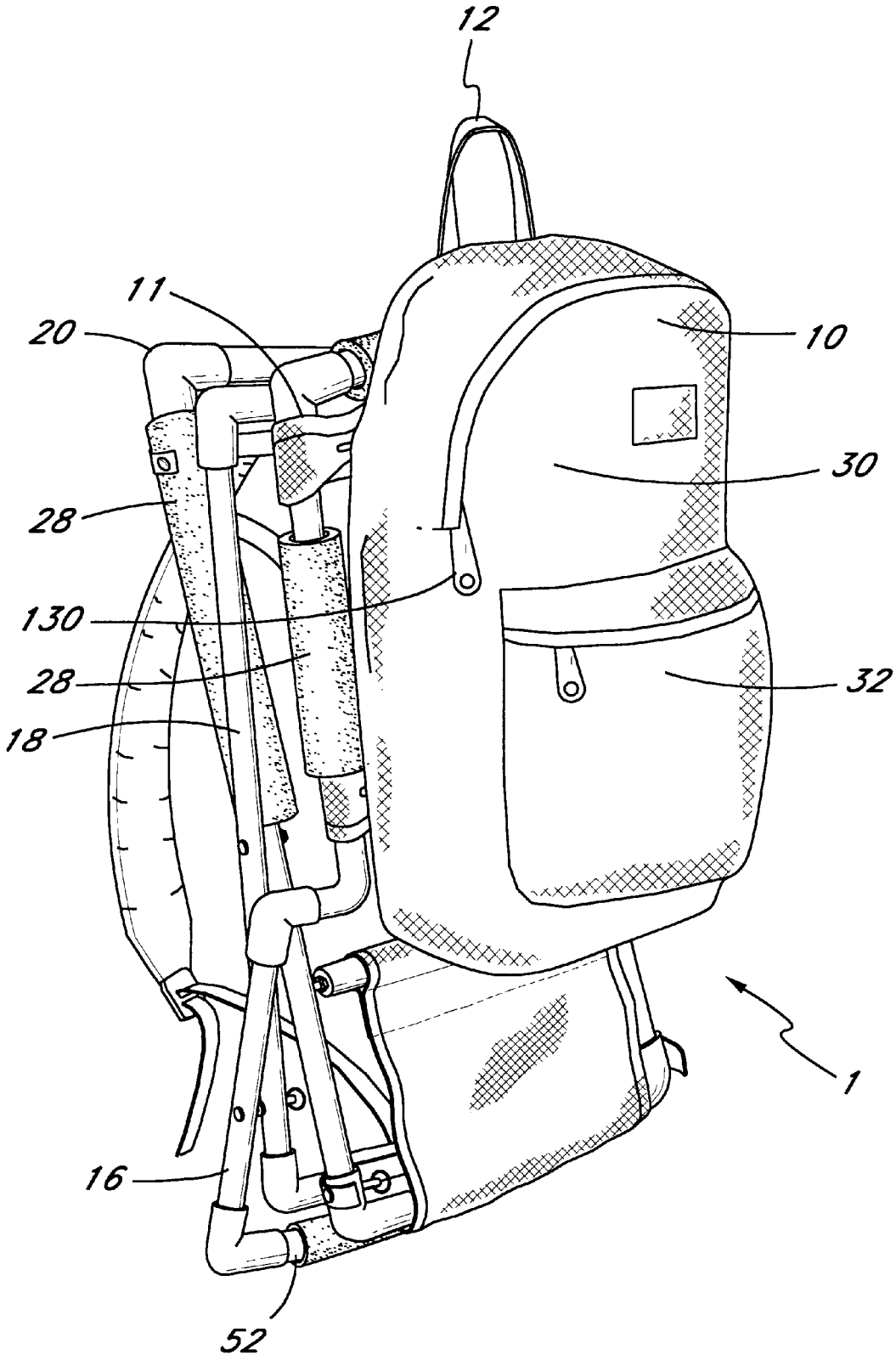
FIG. 1 is a front perspective view of one embodiment of the portable chair in its folded configuration, the chair not including a headrest or an arm rest.
Figure 2:
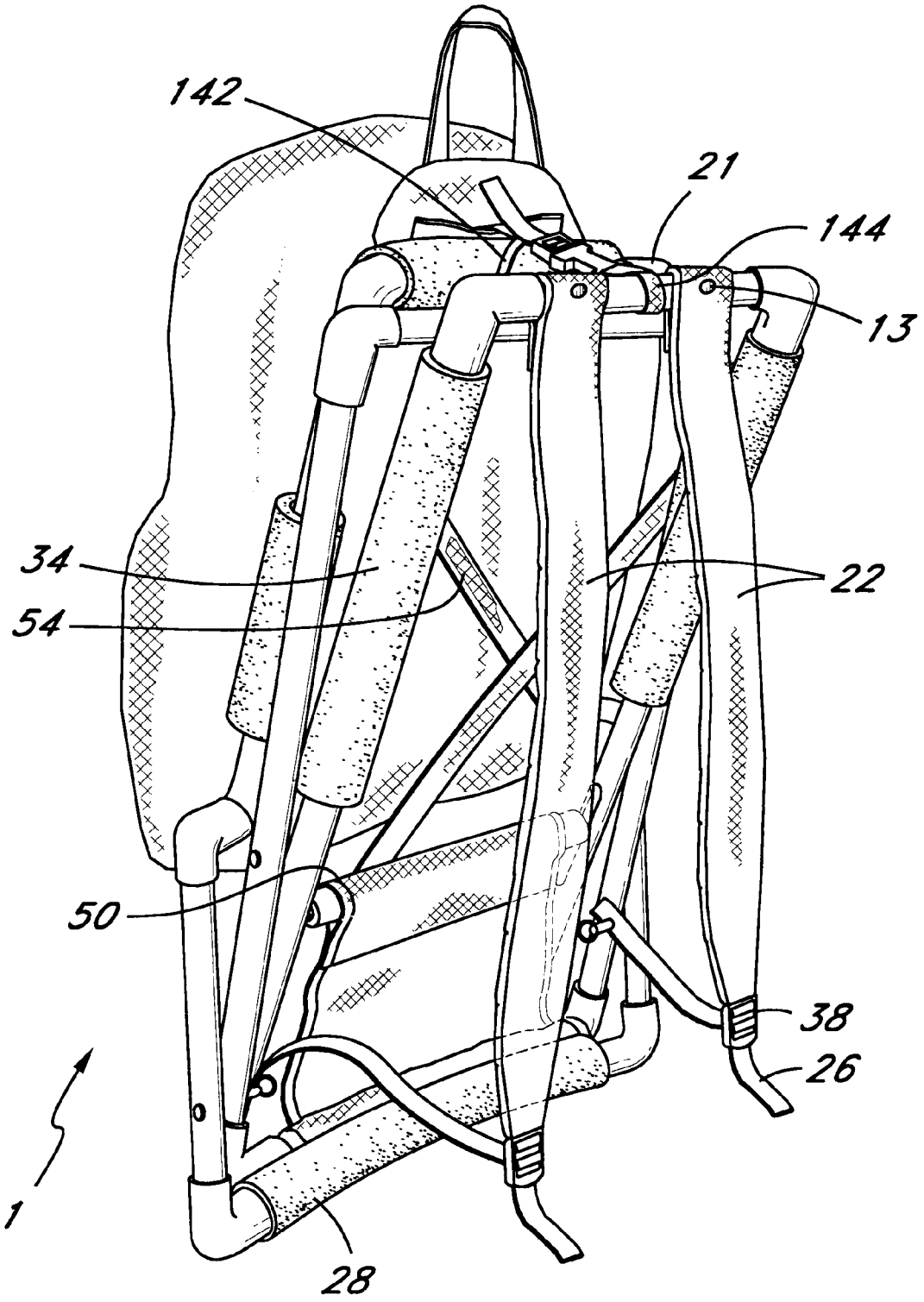
FIG. 2 is a back perspective view thereof.

The above-described drawing figures illustrate the invention, a portable chair 1 that is adjustable between a first folded and portable position, shown in FIGS. 1, 2, and 7, and a second unfolded, spread apart position for sitting in the chair 1, shown in FIGS. 3, 4, 5, 6, and 8. The chair 1 has a pair of hingably joined front and rear seat support frames 18 and 20. The front and rear leg frames 18 and 20 are rotatably connected with a front and rear leg frame support connection 15, preferably a pair of pins and locking-rings such as those sold under the trademark CLEVIS™. The front and rear seat support frames 18 and 20 preferably each have a pair of generally parallel support legs connected by a pair of generally perpendicular cross bars, thereby forming a pair of generally rectangular frames. The front seat support frame 18 is preferably a rectangular frame approximately 18 inches long and 14 inches wide. This rear seat support frame 20 is preferably a rectangular frame approximately 21 inches long and 13 inches wide. It is important that the rear seat support frame 20 is longer than the front seat support frame 18 because this provides the chair 1 with the stability necessary for the proper function of the chair 1, as described below. The front and rear seat support frames 18 and 20 are preferably made of high strength aluminum such as T6 grade aluminum. Steel or other durable and rigid materials may be used, but high quality aluminum is preferred due to decreased weight.

A back support frame 16 is rotatably connected to the front leg means 18 with a front and back frame support connection 17. The back support frame 16 is preferably wider than, and fits around, the front seat support frame 18. The back support frame 16 preferably has a bottom crossbar 16*a* that contacts the front seat support frame 18 when the chair 1 is in its unfolded sitting configuration, thereby holding the back support frame 16 in an upright orientation and allowing a person to sit in the chair 1 and lean back against the back support frame 16 without causing the chair 1 to collapse. The front and rear frame support connection 17 is preferably a pair of pins and locking rings similar to the front and rear leg frame support connection 15. The specific method of connecting these frames is not critical to the invention and those skilled in the art can devise countless alternative embodiments that are equivalent to the CLEVIS™ pin without deviating from the inventive nature of this invention. Equivalent alternative embodiments are considered within the scope of this invention. It is also important to note that the front and rear seat support frames 18 and 20, and the back support frame 16, are not required to be rectangular. Substantial modifications may be made to these frames by those skilled in the art without deviating from the spirit of this invention.

Figure 8:
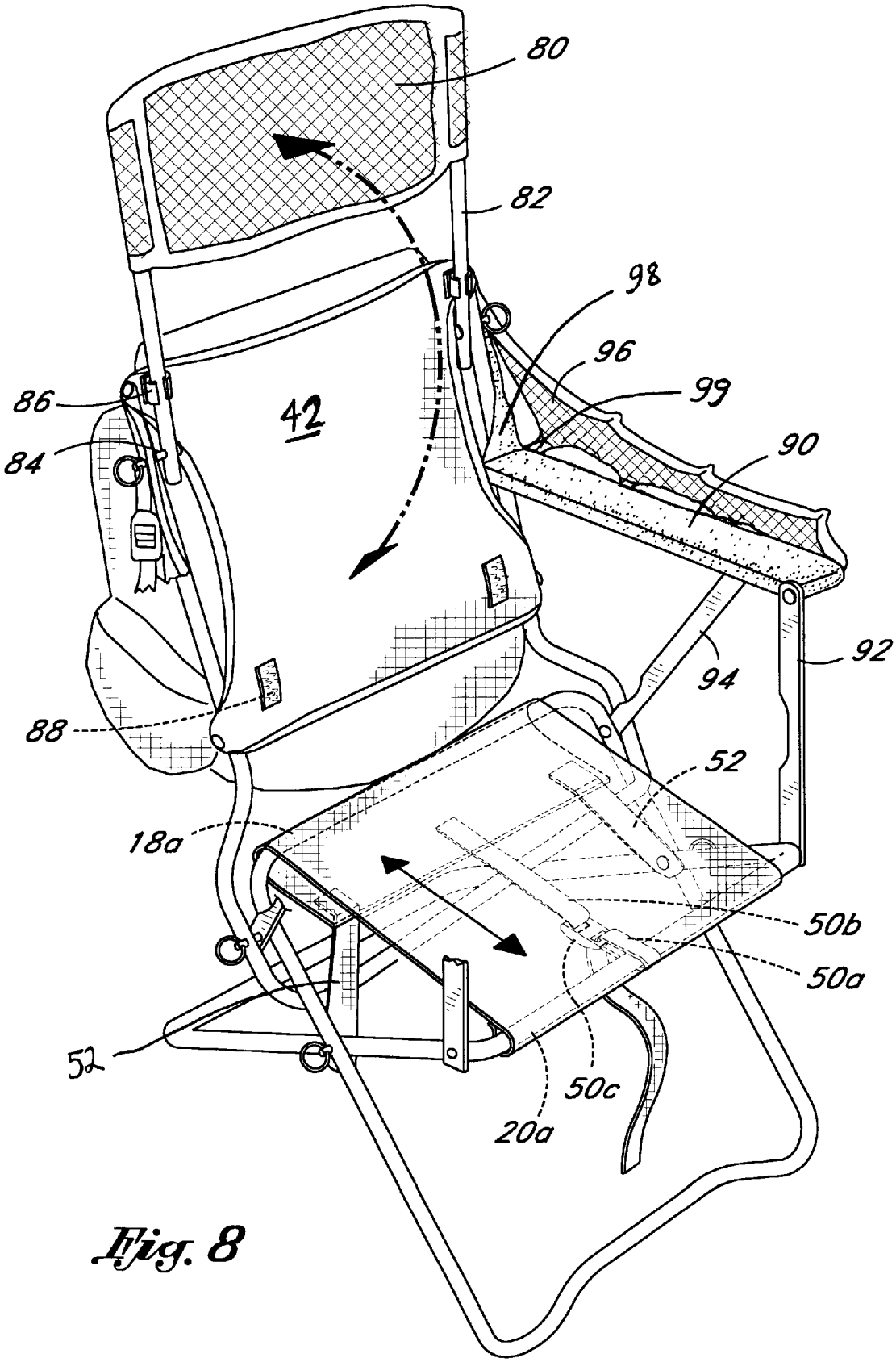
FIG. 8 is a perspective view thereof, the chair being in its unfolded configuration, and one of the arm rests being cut away to illustrate an adjustment strap useful for reclining the chair.

A seat means 24, preferably a flexible seat material, joins the front and rear seat support frames 18 and 20. The seat material 24 provides an upwardly facing surface 150 for sitting upon when the seat support frames 18 and 20 are in the second spread apart position, whereby the support frames are self supporting on a support surface for placing the seat material 24 at a convenient height. As shown in FIG. 8, the seat material 24 is preferably fixedly attached to a top cross beam 20*a* of the rear seat support frame 20, wrapped over a top cross bar 18*a* of the front seat support frame 18, and attached to the top cross beam 20*a* with an adjustment means 50. The adjustment means 50 is preferably formed by attaching the seat material 24 to the top cross bar 20*a* of the rear seat support frame 20 with a first and second adjustment straps 50*a* and 50*b* and a buckle 50*c*. The first adjustment strap 50*a* is fixedly attached to the top cross bar 20*a*, preferably by sewing the strap into a loop around the frame. The second adjustment strap 50*b* is fixedly attached to the seat material 24, preferably by sewing the strap directly to the seat. The first and second adjustment straps 50*a* and 50*b* are then connected with the buckle 50*c*. By sliding the first adjustment strap 50*b* through the buckle 50*c*, the user can adjust the width of the upwardly facing surface 150, the distance between the front and rear seat support frames 18 and 20, the and the angle of the back support frame 16. The seat material 24 is preferably also attached to the frame with an elastic strip 52 to prevent the seat material 24 from falling off the chair 1.

Figure 3:
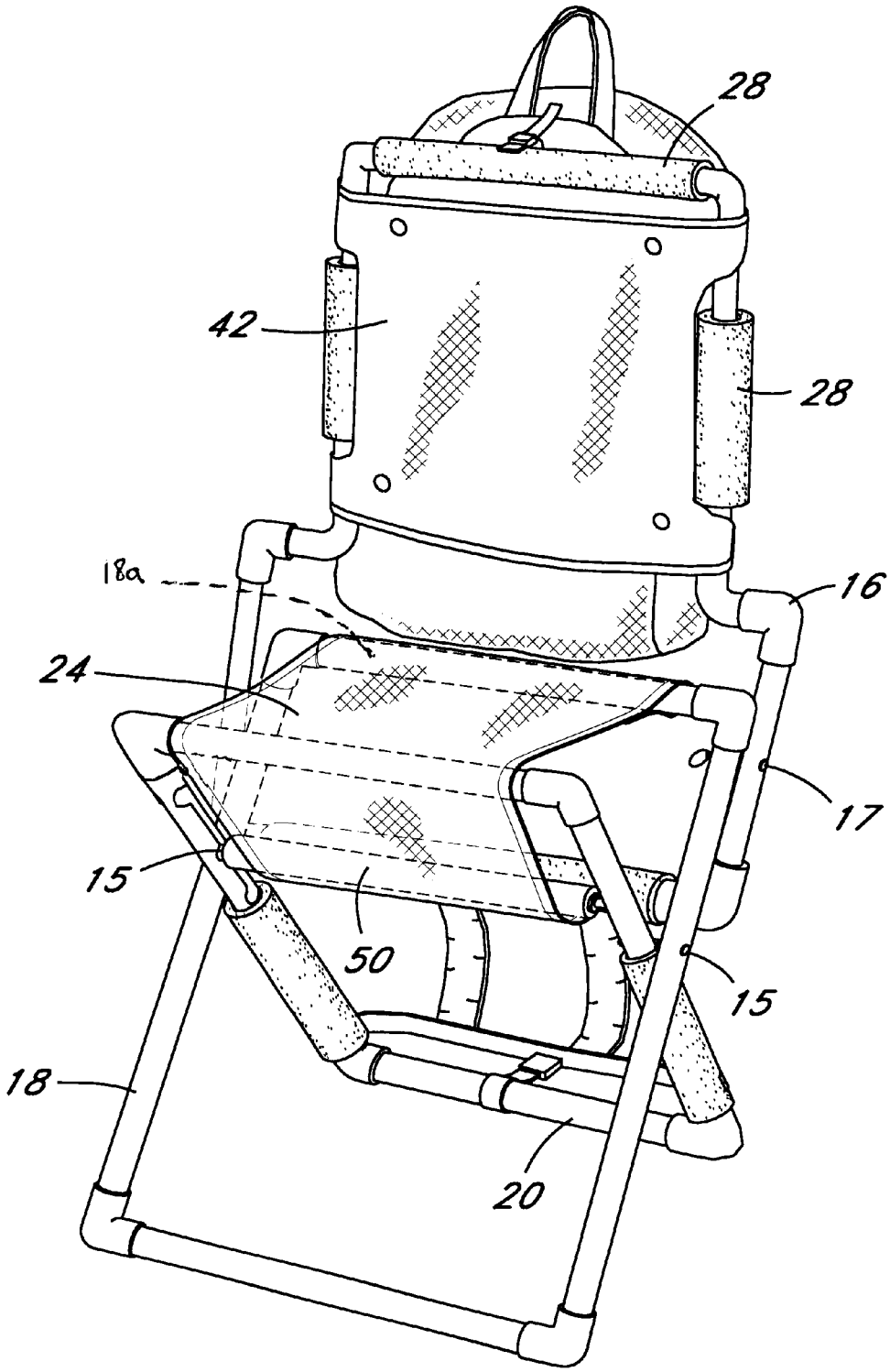
FIG. 3 is a front perspective view of the chair in its unfolded configuration, showing an adjustment bar for reclining the chair.
Figure 4:
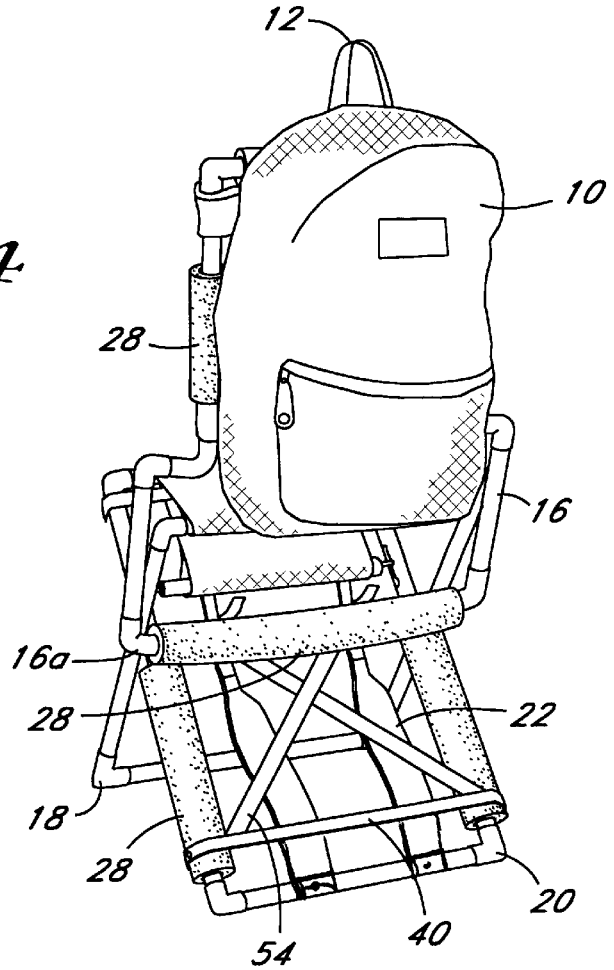
FIG. 4 is a back perspective view thereof.
Figure 5:
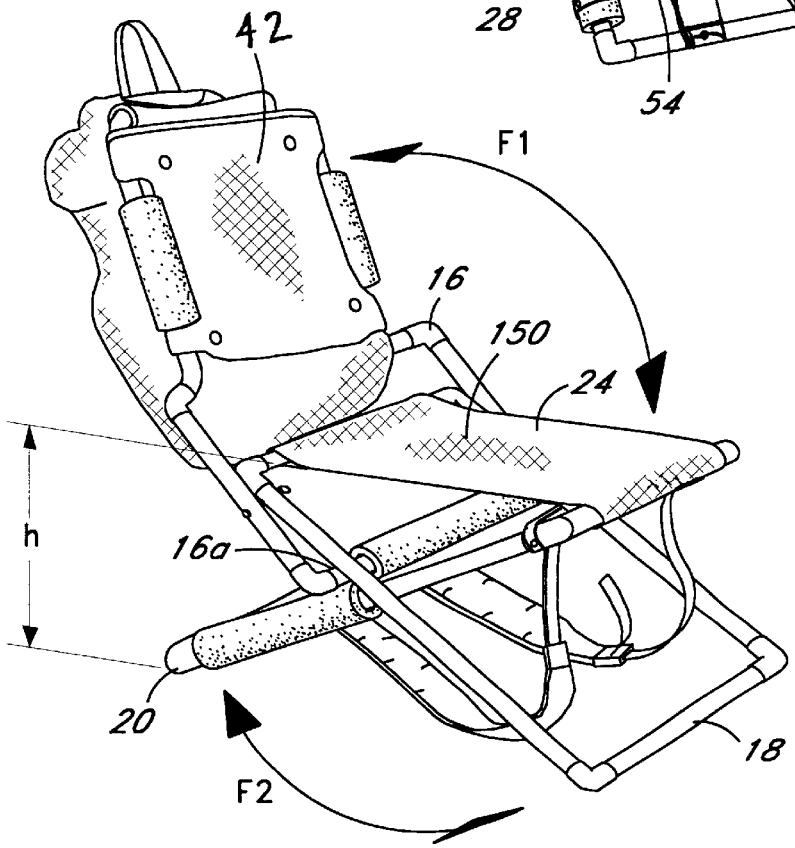
FIG. 5 is a front perspective view thereof, showing the invention in a reclining position, and showing how the chair folds while in use.

In an alternative embodiment, shown in FIG. 3, the seat material 24 is fixedly attached to the top cross bar 18*a* of the front seat support frame 18, wrapped over the top cross beam 20*a* of the rear seat support frame 20, and attached to the rear seat support frame 20 with an adjustment means 50, also described below. In this alternative embodiment, the adjustment means 50 is an adjustment bar. In this embodiment, the seat material 24 is fixedly attached to the cross beam 18*a* and wrapped over the top of the top cross bar 20*a* and attached to the adjustment bar 50; and the adjustment bar 50 removably attaches to a plurality of adjustment positions 51 located on the rear seat support frame 20. This allows the angle of the rear leg frame means 20 relative to the front leg frame means 18 to be adjusted to different levels for sitting or lounging, as shown in FIG. 5. Of course, it is also possible to simply fixedly attach, by sewing or an equivalent, the seat means 24 to both the cross beam 18*a* and the top cross bar 20*a*.

As shown in FIG. 1, the back support frame 16 preferably includes a storage means 10, preferably a backpack. The backpack 10 is preferably attached to the back support frame 16 with CLEVIS® pins and locking rings through a pack attachment strap 11 having a reinforcing metal eyelett. Removable CLEVIS® pins are preferred so the backpack 10 can easily be removed for cleaning. In an alternative embodiment, the backpack 10 is mounted to the back support frame 16 with a pack attachment loop 11 that is sewn to the backpack 10 around the back support frame 16. The backpack 10 is preferably a bag made out of a flexible and substantially inelastic material such as nylon. The backpack 10 has a primary storage chamber 30 that is preferably closable with a closing means 130 such as a zipper. In addition, the backpack 10 preferably further includes an additional pocket 32, although those skilled in the art can easily devise a host of storage configurations, especially for many different specialty products that may be adapted to this technology. Additional storage compartments may be of any size, shape or color, but preferably a size or shape that is proportionate to the pack 10 as a whole. These modifications are all considered within the scope of this invention and should be considered equivalent to the preferred embodiment shown in the included drawings. While the storage means 10 is preferably a backpack, it can be a wide variety of attachments, including a baby carrier or any number of specialty holding devices. Any devices that are currently carried on a person's back could be converted for use with this invention and so therefore should be considered equivalent to the current invention.

A shoulder mounting means 22 attached to one of the seat support frames 18 and 20 such that with the pair of set support frames 18 and 20 placed into the mutually aligned folded position, and with the back support frame 16 placed into the laid-over position, the combination is mountable onto a person's back. The shoulder mounting means 22 is preferably a padded shoulder strap attached to the rear support frame 20. As shown in FIG. 2, each of the padded shoulder straps 22 is preferably connected to an adjustment strap 26 with an adjustment buckle 38. Sliding the adjustment strap 26 through the adjustment buckle 38 allows the user to adjust the padded shoulder straps 22 for optimal fit. Such an arrangement is well known in the prior art.

The chair 1 further includes a means for removably connecting the back support frame 16 and the rear seat support frame 20, thereby holding the front and rear seat support frames 18 and 20 in the first mutually aligned position, and the back support frame 16 in the laid-over position, for carrying the chair 1. The means for removably connecting 21 is preferably a male parachute clip 142 attached to the rear seat support frame 20, and a female parachute clip 144 attached to the back support frame 16. The male and female parachute clips 142 and 144 cooperate to removably engage each other, thereby securing the chair 1 in the folded position, as illustrated in FIG. 2.

The chair 1 further includes a variety of features, in its preferred embodiment, to enhance the utility and marketability of the invention. Various cushions 28, preferably made of a soft durable material such as polyurethane, are mounted or molded around the back support frame 16 to provide comfort to the user when sitting in the chair 1 or carrying the chair 1 on his back. In an alternative embodiment, additional cushions 28 are also added to the front and rear seat support frames 18 and 20 for additional comfort while carrying the chair 1. The specific structure and placement of the cushions 28 is not critical to the inventive nature of this invention, and any number of comparable structures can be designed by those skilled in the art. The pack 10 preferably further has a loop strap handle 12, preferably made of nylon, to facilitate carrying the portable chair 1. To enhance the comfort of the chair 1 in this unfolded configuration, the chair 1 includes a chair backing 42. The chair backing 42, preferably a sheet of flexible and inelastic material such as nylon, covers the upper portion of the back support frame 16 to support the user's back while sitting in the portable chair 1. As shown in FIG. 2, the chair 1 further includes a crossing back strap support system 54. The crossing back strap support system 54 is attached to the rear-leg support frame 20, thereby providing support to a person's back as the portable chair 1 is being worn. Those skilled in the art can devise countless alternative embodiments which are equivalent to these support systems without adding to the inventive nature of this invention.

As shown in FIGS. 6–8, the chair 1 preferably includes a headrest 82 having a head supporting surface 80. The headrest 82 is preferably hingably joined to the back support frame 16 for rotating the headrest between a closed position wherein the head supporting surface 80 is within the back support frame 16, and an open position wherein the head supporting surface 80 extends above and is supported by the back support frame 16. The headrest 82 preferably further includes a means for fastening the headrest in the open position 86. The fastening means 86 is preferably a hooks and loops fastening material, sold under the trademark VELCRO®, attached to the headrest and the back support frame. A second fastening means 88 is preferably provided to fasten the headrest 82 into the closed position.

As shown in FIGS. 6–8, the chair 1 preferably also includes at least one armrest 90. Each armrest 90 preferably has an outer end 90*a* and an inner end 90*b*. The inner end 90*b* is preferably fastened to the back support frame 16 through a flexible portion 98, preferably a vinyl strap. The outer end 90*a* is supported on one of the seat support frames 18 or 20 with at least one rigid support bar 92 or 94. In its preferred embodiment, the armrest 90 is supported by both a first support bar 92 that is rotatably supported on the front seat support frame 18, and a second support bar 94 that is rotatably supported on the rear seat support frame 20. The armrest 90 preferably further includes a flexible webbing 96 attached to the armrest 90 and the back support frame 16 with a plurality of fastening straps 99. The webbing 96 provides lateral support to the user's arms while lounging in the chair 1. Neither the headrest 82 nor the armrests 90 impede the folding of the chair 1; and they do not add significant weight to the chair 1.

In use, the portable chair 1 is taken off the back of the user by pulling shoulder straps 22 off the user's shoulders and holding the portable chair 1 in one hand. The user then unlatches the male and female parachute clips 142 and 144 with his free hand. Once unlatched, the front and rear seat support frames 18 and 20 fall away from the back support frame 16 and gravity causes the portable chair 1 to open and unfold. As shown in FIG. 5, the rear leg frame means 20 and the front leg frame means 18 both unfold along a first folding line F1 until the front leg frame means 18 contacts the bottom crossbar 16*a*. The user can then continue to rotate the rear seat support frame 20 along a second folding line F2 until the seat material 24 stops the rotation of the rear leg frame means 20. In this position, the portable chair 1 is in its unfolded chair formation and ready for a person to sit in the portable chair 1. As a person sits in the portable chair 1, the seat material 24 and the back support frame 16 hold the person in a comfortable position and transfer the weight of the person through front and rear seat support frames 18 and 20.

Once the portable chair 1 has served its purpose as a chair, the next steps are taken to convert it back into a folded configuration for transportation. The portable chair 1 is picked up with one hand by the loop strap handle 12. Gravity causes the rear leg frame means 20 to fold along a second folding line F2. The user then rotates both the front leg frame means 18 and the rear leg frame means 20 along a second folding line F2 until they rest against the back support frame 16. Once this is accomplished, the user reconnects the male and female parachute clips 142 and 144 to secure the portable chair 1 in its folded configuration. To place the portable chair 1 on the back again simply pick it up by loop strap handle 12, the user simply positions the portable chair 1 it over his or her back and mounts the chair 1 on his or her back with the shoulder straps 22.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A folding chair comprising:

a front and rear seat support frame cross each other and are hingably joined for rotating the seat support frames between a first mutually aligned position for carrying the folding chair, and a second spread apart position for sitting;

a flexible seat member joining the seat support frames and providing an upwardly facing surface when the seat support frames are in the second spread apart position, whereby the support frames are self supporting on a support surface for placing the flexible seat member at a convenient height;

a back support frame hingably joined to the front seat support frame and rotatable between an upwardly extending position for establishing a back rest, and a laid-over position wherein the back support frame abuts the seat support frames, the back support frame having a horizontal member that abuts the front seat support frame opposite the flexible seat member when the back support frame is in the upwardly extending position, thereby preventing the back support frame from rotating beyond the upwardly extending position when the folding chair is in use; and at least one armrest, the armrest having an inner end and an outer end, the inner end being fastened to the back support frame through a flexible portion, and the outer end being supported by one of the seat support frames with at least one rigid support bar.

2. The folding chair of claim 1 wherein the armrest further includes a flexible webbing attached to the armrest and the back support frame with a plurality of fastening straps.

3. The folding chair of claim 2 wherein the adjustment means is a first and second adjustment strap and a buckle, the first adjustment strap being fixedly attached to a top cross bar of the rear seat support frame, the second adjustment strap being fixedly attached to the flexible seat member and the first and second adjustment straps being slidably connected with the buckle, whereby sliding the first adjustment strap through the buckle adjusts the width of the flexible seat member and the angle of the back support frame.

4. The folding chair of claim 1 further comprising:

a back pack joined to the back support frame; and a shoulder mounting means attached to the rear seat support frame such that with the front and rear seat support frames placed into the mutually aligned position, and with the back support frame placed into the laid-over position, the combination is mountable onto a person's back for carrying thereon.

5. The combination chair and backpack of claim 1 further comprising an adjustment means connecting the flexible seat member to the front and rear seat support frames, the adjustment means allowing adjustment of the distance between the front and rear seat support frames when the combination chair and backpack is in the second spread apart position for sitting, thereby causing the back support frame to recline.

6. The folding chair of claim 1 wherein the rear seat support frame is longer than the front seat support frame.

7. The folding chair of claim 1 further including a means for removably connecting the rear seat support frame and the back support frame to hold the front and rear seat support frames in the first mutually aligned position and the back support frame in the laid-over position, for carrying the folding chair.

8. A folding chair comprising:

a front and rear seat support frame cross each other and are hingably joined for rotating the seat support frames between a first mutually aligned position for carrying the folding chair, and a second spread apart position for sitting;

a flexible seat member joining the seat support frames and providing an upwardly facing surface when the seat support frames are in the second spread apart position, whereby the support frames are self supporting on a support surface for placing the flexible seat member at a convenient height;

a back support frame hingably joined to the front seat support frame and rotatable between an upwardly extending position for establishing a back rest, and a laid-over position wherein the back support frame abuts the seat support frames, the back support frame having a horizontal member that abuts the front seat support frame opposite the flexible seat member when the back support frame is in the upwardly extending position, thereby preventing the back support frame from rotating beyond the upwardly extending position when the folding chair is in use; and a headrest having a head supporting surface, the headrest being hingably joined to the back support frame for rotating the headrest between a closed position wherein the head supporting surface is within the back support frame, and an open position wherein the head supporting surface extends above and is supported by the back support frame.

9. The folding chair of claim 8 wherein the headrest further includes a means for fastening the headrest in the open position.

10. The folding chair of claim 9 wherein the means for fastening the headrest in the open position is a hooks and loops fastening material attached to the headrest and the back support frame.

11. The folding chair of claim 9 wherein the adjustment means is a first and second adjustment strap and a buckle, the first adjustment strap being fixedly attached to a top cross bar of the rear seat support frame, the second adjustment strap being fixedly attached to the flexible seat member and the first and second adjustment straps being slidably connected with the buckle, whereby sliding the first adjustment strap through the buckle adjusts the width of the flexible seat member and the angle of the back support frame.

12. The folding chair of claim 8 further comprising:

a back pack joined to the back support frame; and a shoulder mounting means attached to the rear seat support frame such that with the pair of set support frames placed into the mutually aligned position, and with the back support frame placed into the laid-over position, the folding chair is mountable onto a person's back for carrying thereon.

13. The folding chair of claim 8 further comprising an adjustment means connecting the flexible seat member to the front and rear seat support frames, the adjustment means allowing adjustment of the distance between the front and rear seat support frames when the combination chair and backpack is in the second spread apart position for sitting, thereby causing the back support frame to recline.

14. The folding chair of claim 8 wherein the rear seat support frame is longer than the front seat support frame.

15. The folding chair of claim 8 further including a means for removably connecting the rear seat support frame and the back support frame, thereby holding the front and rear seat support frames in the first mutually aligned position, and the back support frame in the laid-over position, for carrying the folding chair.

* * * * *

UNITED STATES PATENT AND TRADEMARK OFFICE

CERTIFICATE OF CORRECTION

PATENT NO. : 6,547,324 B1
DATED : April 15, 2003
INVENTOR(S) : Ammann

It is certified that error appears in the above-identified patent and that said Letters Patent is hereby corrected as shown below:

Title page,
Item [*] Notice, delete "0" and add -- 481 --.

Signed and Sealed this

Thirtieth Day of August, 2005

JON W. DUDAS
*Director of the United States Patent and Trademark Office*